US010138051B2

(12) United States Patent
Buggs

(10) Patent No.: US 10,138,051 B2
(45) Date of Patent: Nov. 27, 2018

(54) GLOVE AND HAND PRODUCT CADDY ASSEMBLY

(71) Applicant: Feli Buggs, Katy, TX (US)

(72) Inventor: Feli Buggs, Katy, TX (US)

( * ) Notice: Subject to any disclaimer, the term of this patent is extended or adjusted under 35 U.S.C. 154(b) by 0 days.

(21) Appl. No.: 15/379,639

(22) Filed: Dec. 15, 2016

(65) Prior Publication Data

US 2018/0170661 A1 Jun. 21, 2018

(51) Int. Cl.
*B65D 85/00* (2006.01)
*B65D 25/24* (2006.01)
*D06F 59/04* (2006.01)

(52) U.S. Cl.
CPC ..... *B65D 85/70* (2013.01); *B65D 25/24* (2013.01); *D06F 59/04* (2013.01)

(58) Field of Classification Search
CPC ..... B65D 85/70; B65D 25/24; B65D 85/00; D06F 59/04
USPC ..... 206/216; 211/85.3; 223/78
See application file for complete search history.

(56) References Cited

U.S. PATENT DOCUMENTS 3,166,439 A 1/1965 Dennhofer
D285,509 S 9/1986 Sussman
D341,463 S * 11/1993 Booth ..... D3/306
5,406,717 A * 4/1995 Dofka ..... D06F 59/04 211/37
5,423,437 A * 6/1995 Kayem ..... A47F 5/01 211/181.1
D428,560 S 7/2000 Patel et al.
6,085,436 A * 7/2000 Peet ..... D06F 59/04 223/78
6,530,502 B2 3/2003 Neal
D585,169 S * 1/2009 Barzegar ..... D32/58
9,033,195 B1 * 5/2015 Martinez-Ramos .... D06F 59/04 211/85.3
9,512,556 B1 * 12/2016 Kazravan ..... D06F 59/04
2006/0260962 A1 * 11/2006 Dickens ..... A47G 23/08 206/310
2013/0233816 A1 * 9/2013 Greenfield ..... A47B 81/02 211/85.3

FOREIGN PATENT DOCUMENTS

WO WO2014042466 3/2014

* cited by examiner

*Primary Examiner* — Steven A. Reynolds

(57) ABSTRACT

A glove and hand product caddy assembly includes a housing that has a bottom wall and a perimeter wall that is attached to and extends upwardly therefrom. Each of a pair of posts is attached to and extends upwardly from the housing. The posts each have a bottom end and a top end. A pair of glove engagement members is provided. Each of the top ends has one of the glove engagement members attached thereto. The glove engagement members include five protruding members. Each of the protruding members is extendable into one of a plurality of finger sleeves.

5 Claims, 4 Drawing Sheets

GLOVE AND HAND PRODUCT CADDY ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to glove drying devices and more particularly pertains to a new glove drying device for holding a plurality of products as well as providing mounts for holding gloves and drying the same.

BRIEF SUMMARY OF THE INVENTION

An embodiment of the disclosure meets the needs presented above by generally comprising a housing that has a bottom wall and a perimeter wall that is attached to and extends upwardly therefrom. Each of a pair of posts is attached to and extends upwardly from the housing. The posts each have a bottom end and a top end. A pair of glove engagement members is provided. Each of the top ends has one of the glove engagement members attached thereto. The glove engagement members include five protruding members. Each of the protruding members is extendable into one of a plurality of finger sleeves.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
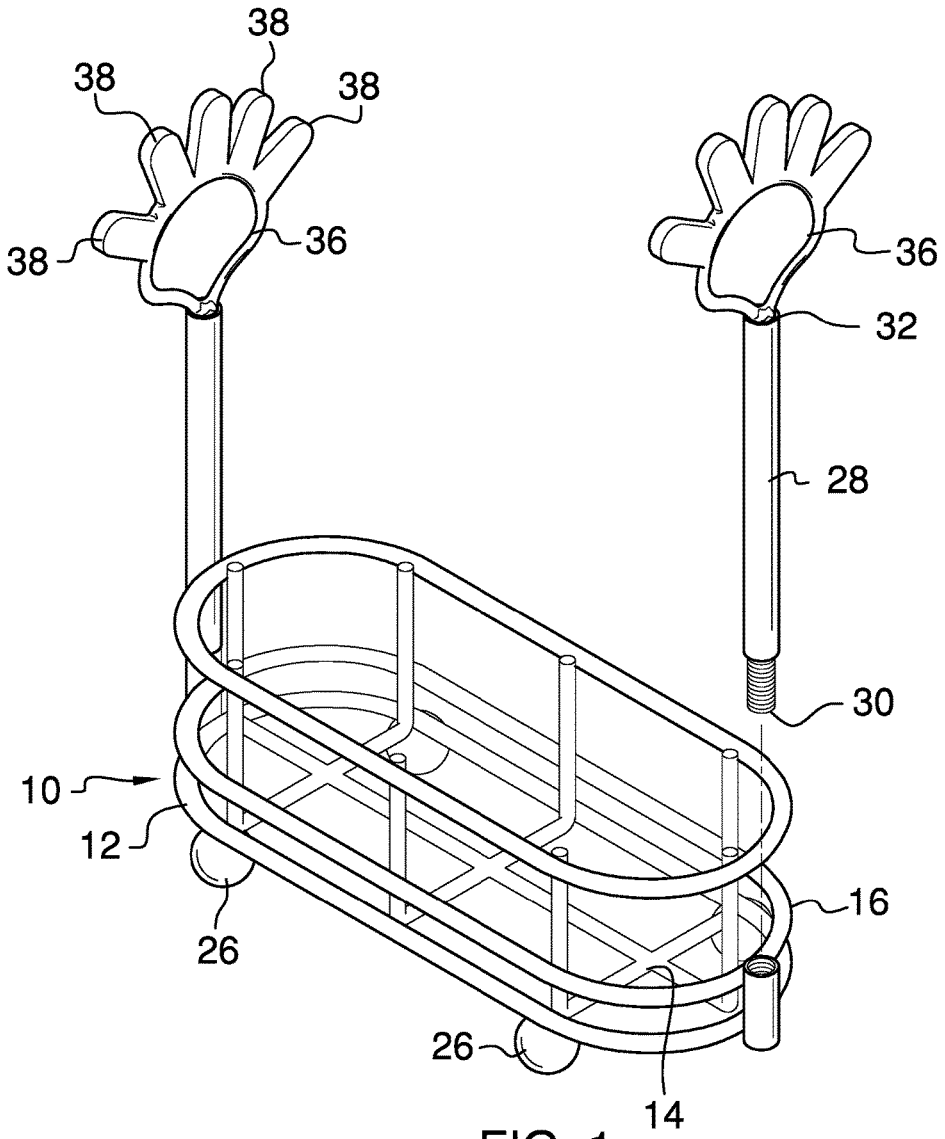
FIG. 1 is a front perspective view of a glove and hand product caddy assembly according to an embodiment of the disclosure.
Figure 2:
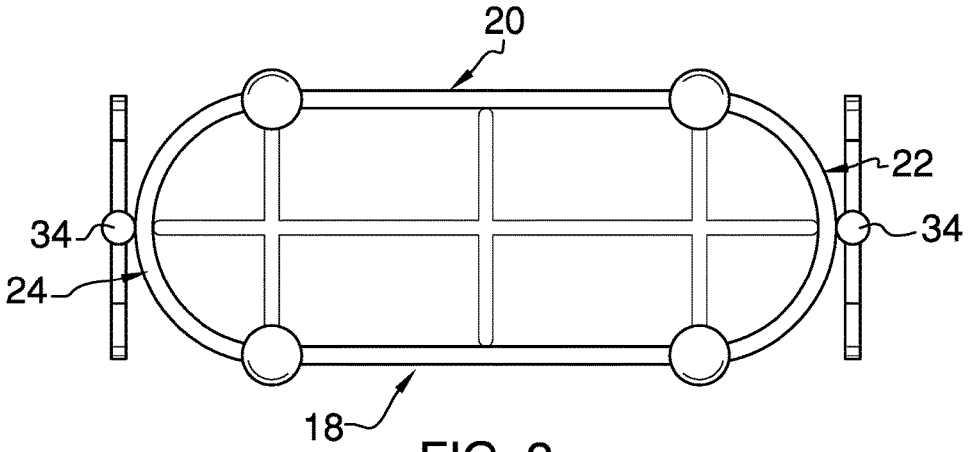
FIG. 2 is a bottom view of an embodiment of the disclosure.
Figure 3:
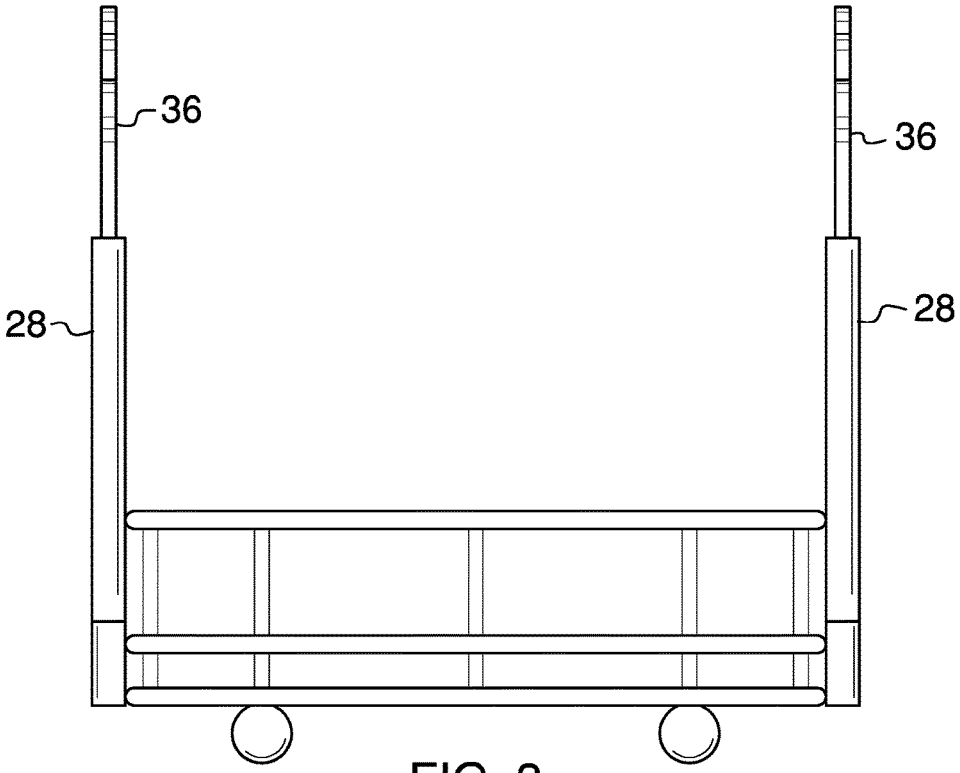
FIG. 3 is a front view of an embodiment of the disclosure.
Figure 4:
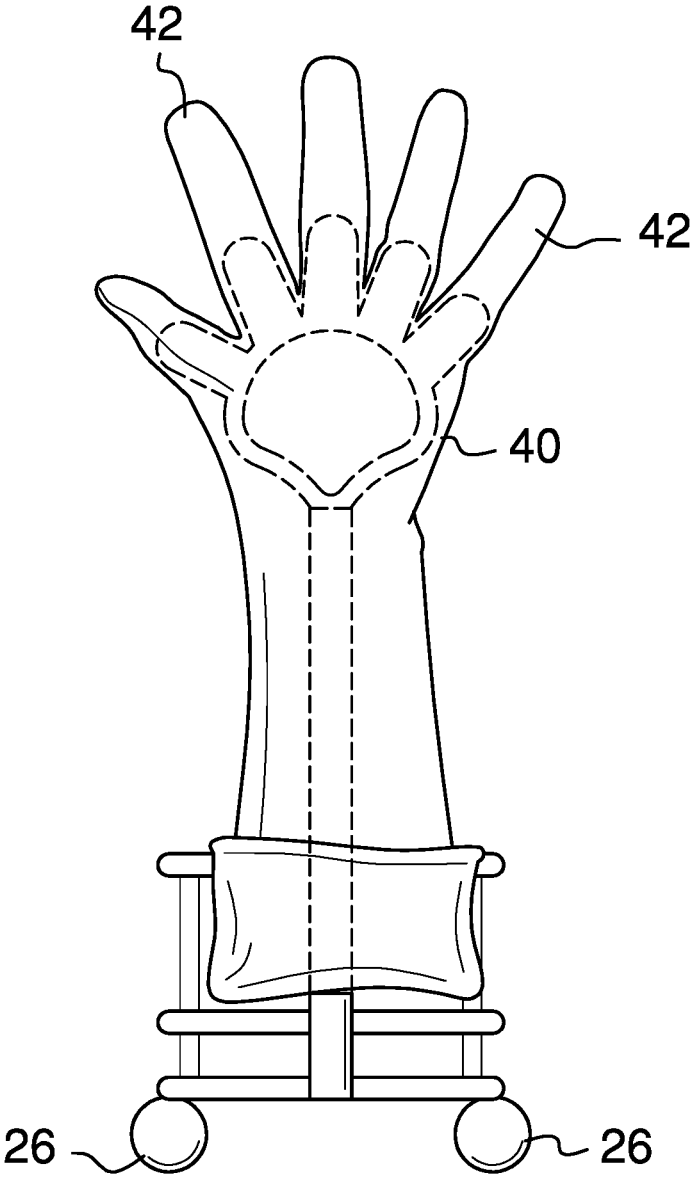
FIG. 4 is a side view of an embodiment of the disclosure.
Figure 5:
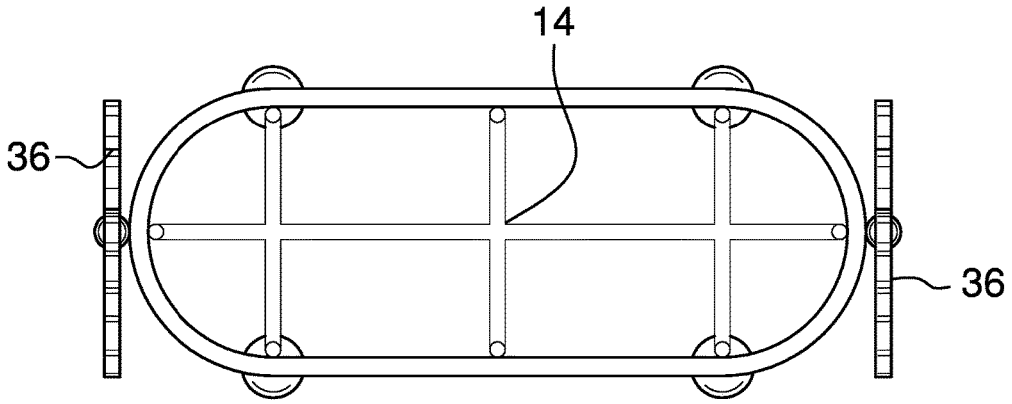
FIG. 5 is a top view of an embodiment of the disclosure.

With reference now to the drawings, and in particular to FIGS. 1 through 5 thereof, a new glove drying device embodying the principles and concepts of an embodiment of the disclosure and generally designated by the reference numeral 10 will be described.

As best illustrated in FIGS. 1 through 5, the glove and hand product caddy assembly 10 generally comprises a housing 12 that has a bottom wall 14 and a perimeter wall 16 that is attached to and extends upwardly therefrom. The bottom 14 and perimeter 16 walls comprise a lattice of rods to allow air to flow through the housing 12. The rods may be comprised of a metal or plastic material and more specifically may be comprised of wrought iron. The perimeter wall 16 includes a front wall 18, a rear wall 20, a first side wall 22 and a second side wall 24. A plurality of foot members 26 is attached to and extends downwardly from the housing 12. The foot members 26 may each have a height between 1.0 inches and 4.0 inches. A distance between the front wall 18 and the rear wall 20 may be between 3.0 inches and 6.0 inches and a distance from the first side wall 22 to the second side wall 22 may be between 7.0 inches and 12.0 inches.

A pair of posts 28 is provided. Each of the posts 28 is attached to and extends upwardly from the housing 12. Each of the posts 28 has a bottom end 30 and a top end 32. A pair of receivers 34 is attached to the housing 12 and each of the bottom ends 30 are threadably coupled to one of the receivers 34. Each of the first 22 and second 24 side walls has one of the receivers 34 positioned adjacent thereto.

A pair of glove engagement members 36 is provided and each of the top ends 32 has one of the glove engagement members 36 attached thereto. Each of the glove engagement members 36 includes five protruding members 38 in a general hand shape. The protruding members 36 are configured to be extended into one of a plurality of finger sleeves 42 of a glove 40. This keeps the finger sleeves 42 separated from each other to facilitate drying of the finger sleeves 42. The posts 28, receivers 34 and glove engagement members 36 may have a combined height of between 8.0 inches and 14.0 inches. The glove engagement members 36 may be removable from the posts 28 and each may be positioned within the housing when not in use.

In use, cleaning or hand care products are positionable in the housing 12. Gloves 40, used for covering the hands while they are being treated or used to protect a person's hands while cleaning, are positionable on the glove engagement members 36. The gloves 40 may be cloth or rubber gloves that are cleaned after usage and placed on the glove engagement members 36 to dry after cleaning. The housing 12 may include small containers, cups, or trays and the like for holding variously sized articles.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A glove and product holding assembly comprising:

a housing having a bottom wall and a perimeter wall being attached to and extending upwardly therefrom;

a pair of posts, each of said posts being attached to and extending upwardly from said housing, each of said posts having a bottom end and a top end; and a pair of glove engagement members, each of said top ends having one of said glove engagement members attached thereto, each of said glove engagement members including five protruding members, each of said protruding members being configured to be extended into one of a plurality of finger sleeves; and a pair of receivers being attached to said housing, each of said receivers extending outwardly from an exterior side of said perimeter wall wherein said pair of receivers is positioned outside of said housing, each of said bottom ends being threadably coupled to one of said receivers wherein said pair of posts are positioned to extend upwardly outside of said housing.

2. The glove and product holding assembly according to claim 1, wherein said bottom and perimeter walls comprise a lattice of rods to allow air to flow through said housing.

3. The glove and product holding assembly according to claim 1, further including a plurality of foot members being attached to and extending downwardly from said housing.

4. The glove and product holding assembly according to claim 1, wherein said perimeter wall includes a front wall, a rear wall, a first side wall and a second side wall, each of said first and second side walls having one of said receivers positioned adjacent thereto.

5. A glove and product holding assembly comprising:

a housing having a bottom wall and a perimeter wall being attached to and extending upwardly therefrom, said bottom and perimeter walls comprising a lattice of rods to allow air to flow through said housing, said perimeter wall including a front wall, a rear wall, a first side wall and a second side wall;

a plurality of foot members being attached to and extending downwardly from said housing;

a pair of posts, each of said posts being attached to and extending upwardly from said housing, each of said posts having a bottom end and a top end;

a pair of receivers being attached to said housing, each of said receivers extending outwardly from an exterior side of said perimeter wall wherein said pair of receivers is positioned outside of said housing, each of said bottom ends being threadably coupled to one of said receivers wherein said pair of posts are positioned to extend upwardly outside of said housing, each of said first and second side walls having one of said receivers positioned adjacent thereto; and a pair of glove engagement members, each of said top ends having one of said glove engagement members attached thereto, each of said glove engagement members including five protruding members, each of said protruding members being configured to be extended into one of a plurality of finger sleeves.

* * * * *